US011499359B2

(12) United States Patent
Köhler et al.

(10) Patent No.: US 11,499,359 B2
(45) Date of Patent: Nov. 15, 2022

(54) DOMESTIC APPLIANCE

(71) Applicant: BSH Hausgeräte GmbH, Munich (DE)

(72) Inventors: Daniel Köhler, Wolpertstetten (DE); Norbert Gerstner, Herbrechtingen (DE); Georg Walther, Bad Boll (DE)

(73) Assignee: BSH Hausgeräte GmbH, Munich (DE)

( * ) Notice: Subject to any disclaimer, the term of this patent is extended or adjusted under 35 U.S.C. 154(b) by 327 days.

(21) Appl. No.: 16/644,981

(22) PCT Filed: Oct. 4, 2018

(86) PCT No.: PCT/EP2018/076944
§ 371 (c)(1),
(2) Date: Mar. 6, 2020

(87) PCT Pub. No.: WO2019/076635
PCT Pub. Date: Apr. 25, 2019

(65) Prior Publication Data

US 2020/0284083 A1 Sep. 10, 2020

(30) Foreign Application Priority Data

Oct. 17, 2017 (DE) ..... 10 2017 218 501.5

(51) Int. Cl.
*E05F 15/627* (2015.01)
*A47L 15/42* (2006.01)
*F24C 15/02* (2006.01)

(52) U.S. Cl.
CPC ..... *E05F 15/627* (2015.01); *A47L 15/4259* (2013.01); *A47L 15/4261* (2013.01);
(Continued)

(58) Field of Classification Search
CPC ..... E05F 15/627; F24C 15/023; E05Y 2900/308; E05Y 2900/304; A47L 15/4293; A47L 15/4259; A47L 15/4261
See application file for complete search history.

(56) References Cited

U.S. PATENT DOCUMENTS 4,951,693 A * 8/1990 Archambault ..... A47L 15/0034 134/58 DL
5,526,706 A * 6/1996 Nelle ..... G01D 5/34769 73/865.8
(Continued)

FOREIGN PATENT DOCUMENTS

EP 0541974 A1 5/1993
EP 2336469 A2 6/2011
(Continued)

OTHER PUBLICATIONS

National Search Report DE 10 2017 218 501.5 dated Jun. 2, 2018.
International Search Report PCT/Ep2018/076944 dated Jan. 7, 2019.

*Primary Examiner* — Benjamin L Osterhout
(74) *Attorney, Agent, or Firm* — Michael E. Tschupp; Andre Pallapies; Brandon G. Braun

(57) ABSTRACT

A household appliance includes a housing, a door pivotably connected to the housing, a cable having one end connected to the door, a motor, and a cable drum onto which the cable can be unwound at least in partial and from which the cable can be unwound at least in part. The cable and the motor interact such that the door pivots when winding the cable onto the cable drum or when the cable unwinds from the cable drum.

15 Claims, 8 Drawing Sheets

(52) U.S. Cl.
CPC ..... *A47L 15/4293* (2013.01); *E05Y 2900/304* (2013.01); *E05Y 2900/308* (2013.01); *F24C 15/023* (2013.01)

(56) References Cited

U.S. PATENT DOCUMENTS

| | | | | |
|---|---|---|---|---|
| 5,903,120 | A * | 5/1999 | Shin | D06F 39/14 220/263 |
| 7,934,783 | B2 * | 5/2011 | Van Vooren | A47L 15/4261 312/328 |
| 8,042,891 | B2 * | 10/2011 | Tynes | A47L 15/4261 312/328 |
| 8,931,859 | B2 * | 1/2015 | Kozinski | E05F 5/00 312/328 |
| 2004/0113531 | A1 | 6/2004 | Raches | |
| 2006/0102165 | A1 | 5/2006 | Lockhart | |
| 2015/0182101 | A1 | 7/2015 | Chae et al. | |
| 2016/0130854 | A1 * | 5/2016 | Carli | F16H 19/04 74/32 |
| 2017/0049295 | A1 * | 2/2017 | Lagness | A47L 15/4257 |
| 2018/0328593 | A1 | 11/2018 | Grobleben et al. | |

FOREIGN PATENT DOCUMENTS

| | | |
|---|---|---|
| GB | 885479 | 12/1961 |
| WO | 2010139536 A1 | 12/2010 |

* cited by examiner

DOMESTIC APPLIANCE

CROSS-REFERENCES TO RELATED APPLICATIONS

This application is the U.S. National Stage of International Application No. PCT/EP2018/076944, filed Oct. 4, 2018, which designated the United States and has been published as International Publication No. WO 2019/076635 A1 and which claims the priority of German Patent Application, Serial No. 10 2017 218 501.5, filed Oct. 17, 2017, pursuant to 35 U.S.C. 119(a)-(d).

BACKGROUND OF THE INVENTION

The present invention relates to a household appliance in particular a water-utilizing household appliance.

Many household appliances, such as by way of example household dishwashers, comprise a pivotable door. Furthermore, the household appliance may comprise a facility that is able to compensate for the weight force of the door in order to avoid the door falling down when in the open position. The facility comprises for this purpose a cable, one end of which is connected to the door and the other end of which is connected to a spring element. The spring element is in turn connected by way of example to a housing of the household appliance. During an opening movement of the door, the spring is by way of example pretensioned with the result that with the aid of the cable a resilient force acts on the door in such a manner that the door is prevented from falling down. Furthermore, friction elements may be provided that hamper a pivot movement of the door. When the door is in the open position, a corresponding friction force may form a difference between the weight force of the door, which pulls on the cable, and the resilient force.

EP 0 541 974 A1 discloses by way of example a dishwasher having an appliance housing in which is provided an electromotive drive. By way of example, it is possible with the aid of the electromotive drive fully or in part to close or open an appliance door of the dishwasher.

BRIEF SUMMARY OF THE INVENTION

On the basis of this background, an object of the present invention is to provide an improved household appliance.

Accordingly, a household appliance is provided having a housing, a door that is pivotably connected to the housing, a cable that has one end connected to the door, a motor and a cable drum onto which it is possible to at least in part wind the cable and from which it is possible at least in part to unwind the cable, wherein the cable and the motor are configured so as by means of winding the cable onto the cable drum or by means of unwinding the cable from the cable drum to cause the door to perform a pivot movement.

By virtue of the fact that a cable drum is used, it is possible to provide a particularly space-saving arrangement. By way of example, it is possible with the aid of the cable drum to directly influence the pivot movement of the door. It is thereby advantageously possible to provide a robust door-opening mechanism since it is possible by way of example to directly transfer force from the cable drum to the cable that pulls on the door. Moreover, a household appliance may be provided with which it is possible using a small number of components to realize an automated door-pivoting movement.

The household appliance is preferably a household dishwasher, a washing machine, a refrigerating appliance, preferably a refrigerator, or an oven. It is preferred that the housing is at least in sections an outermost housing of the household appliance. It is preferred that the housing comprises a base housing and a dishwasher cavity that is arranged on the base housing. The base housing comprises by way of example a base, two opposite-lying outer walls and a rear wall that is arranged opposite the closed door. It is preferred that the base, the outer walls and the rear wall of the base housing are connected to one another and form an essentially cuboid shape. It is preferred that the door is connected to the housing with the aid of a hinge. By way of example, the door pivots with respect to the base on which the household appliance is standing. It is preferred that the door comprises a lever and one end of the cable is connected to said lever. By way of example, another end of the cable is connected to the cable drum. The motor is by way of example an electromotor. By way of example, the motor, the cable and the cable drum are provided in a redundant manner and are arranged accordingly along the two outer walls of the housing.

The term "cable drum" means in this case by way of example a rotatably mounted roller that is configured in such a manner that it is able to wind the cable onto the roller or to unwind the cable from the roller. The term "wind onto" means in this case an increase in a contact surface area between the cable and the cable drum and/or that cable sections are placed on other sections of the cable with the result that a spiral shape is formed. The term "unwind" means in this case a reduction in the contact surface area between the cable and the cable drum and/or that cable sections are released from other sections of the cable. By way of example, during the procedure of unwinding said cable a wrap-angle of the cable around the cable drum is reduced and during the procedure of winding said cable onto said cable drum the wrap-angle of the cable around the cable drum is increased. In so doing, the wrap-angle may be greater than or less than 360°. By way of example, with the aid of winding the cable onto the cable drum, one end of the cable is pulled with the result that the lever of the door is pivoted and thereby the door rotates about the hinge. It is preferred that the cable comprises a synthetic material and/or metal. As an alternative or in addition thereto, the cable may comprise threads and/or textiles, in particular natural fibers and/or synthetic fibers. By way of example, the cable is formed from multiple cable sections that are mechanically connected to one another.

In accordance with one embodiment, the cable drum is drivably connected to the motor and/or is flange-mounted onto the motor.

The cable drum may thereby be directly driven or rotated with the aid of the motor. Furthermore, the cable drum and the motor are thereby arranged in a space-saving manner. By way of example, the motor comprises a drive shaft on which the cable drum sits. It is preferred that the motor is fixedly connected to the housing. By way of example, the cable drum together with the motor may also be described as a cable winch.

In accordance with a further embodiment, the household appliance comprises a further cable, one end of which is connected to the door, wherein the cable and the further cable may be wound synchronously at least in part onto the cable drum and may be unwound at least in part from the cable drum, wherein the cable, the further cable and the motor are configured so as by means of winding the cable and the further cable onto the cable drum or by means of unwinding the cable and the further cable from the cable drum to cause the door to perform a pivot movement.

It is advantageous that it is possible with the aid of the cable drum, the cable and the further cable to create two force drive points on the door. In particular, by way of example a safe pivot movement of the door may thereby be realized. Furthermore, it is possible to prevent the door from tilting. In addition, it is possible to counteract an unsymmetrical pivot movement of the door. By way of example, one end of the further cable is connected to a further lever of the door and the other end of the further cable is connected to the cable drum. It is preferred that the cable drum comprises a first section on which the cable may be wound or from which the cable may be unwound. Furthermore, the cable drum comprises by way of example a second section on which the further cable may be wound or from which the further cable may be unwound. It is preferred that the first section and the second section of the cable drum are arranged in a coaxial manner. By way of example, the first section and the second section of the cable drum are designed in an identical manner and fixedly connected to one another. Furthermore, the first and the second section of the cable drum may be formed from one piece of material.

In accordance with a further embodiment, the household appliance comprises a spring element that is configured so as to compensate at least in part for the weight force of the door.

This has the advantage that it is possible to avoid the door falling down in an uncontrolled manner. Furthermore, it is easier to manually close the door. It is preferred that the spring element is a helical spring. By way of example, a spring characteristic curve of the spring element is progressive, degressive or linear. By way of example, as an opening angle of the door increases, the spring element comes into contact with the door and is thereby pretensioned. It is preferred that the household appliance comprises furthermore a friction element that is configured so as to apply a friction force to the cable. By way of example, a friction force of this type corresponds to a difference between the weight force of the door, which pulls on the cable and likewise on the further cable, and the resilient force. By way of example, it is possible with the aid of the friction element for the door to adopt a resting position at any opening angle. Since the weight force of the door is at least in part compensated for with the aid of the spring element, it is possible to use a motor that has a lower power rating.

In accordance with a further embodiment, the household appliance comprises a rotational element that is configured so as to tension the spring element.

It is advantageous that the spring element may be tensioned or relieved of tension with the aid of a rotational movement and thereby a space-saving arrangement is created. By way of example, one end of the spring element is connected directly to the rotational element. By way of example, the other end of the spring element is connected to the housing. By way of example, the rotational element and the cable drum are drivably connected to one another.

In accordance with a further embodiment, the household appliance comprises an auxiliary cable, wherein the rotational element is configured as an auxiliary cable drum, wherein the auxiliary cable may be wound at least in part onto the auxiliary cable drum or may be unwound at least in part from the auxiliary cable drum and one end of the auxiliary cable is connected to the spring element.

It is advantageously possible with the aid of the auxiliary cable to form an indirect connection (cable connection) between the rotational element and the spring element. It is preferred that the auxiliary cable drum is arranged in a coaxial manner with respect to the cable drum. By way of example, the auxiliary cable drum is fixedly connected to the cable drum. In so doing, the auxiliary cable drum and the cable drum may be embodied as a single cable drum. By way of example, the cable drum and the auxiliary cable drum are configured so as simultaneously to wind on the cable and to unwind the auxiliary cable or simultaneously to unwind the cable and wind on the auxiliary cable. In so doing, by way of example the auxiliary cable and the cable are wound on or unwound in a parallel manner with respect to one another. Furthermore, by using the cable drum and the auxiliary cable drum, the advantage is achieved that preferably slippage does not occur between the cable and the cable drum and/or the auxiliary cable and the auxiliary cable drum.

In accordance with a further embodiment, the rotational element is embodied as a lever that is drivably connected to the cable drum and to the spring element.

The use of a lever has by way of example the advantage that the spring element may be directly connected to the lever and by way of example it is thereby possible to forego an auxiliary cable. By way of example, the lever and the cable drum may be manufactured as an integral injection-molded part. By way of example, the cable drum and the lever are configured so as to rotate about the same central axis.

In accordance with a further embodiment, a first end of the spring element is connected to another end of the cable and a second end of the spring element is connected to the motor and/or to the cable drum.

The spring element is thus arranged by way of example between the cable and the motor and/or the cable drum.

In accordance with a further embodiment, the household appliance comprises a coupler that is configured so as to disconnect a drive connection between the motor and the cable drum and/or the cable.

It is advantageously possible with the aid of the coupler to uncouple the motor from the pivot movement of the door. By way of example, an uncoupling procedure of this type may be referred to as a procedure of switching to idle. By way of example, it is possible thereby to protect the motor and/or to reduce the resistance for a manual movement of the door. It is preferred that the coupler is configured so as in the case of a door resistance limit being exceeded to release with the result that the drive connection between the motor and the cable drum and/or the cable is disconnected. By way of example, a door resistance limit of this type is achieved in the case of an object becoming trapped between the housing and the door. It is advantageously possible thereby to produce a safety device by means of which objects are prevented from becoming squashed. The risk of injury at shearing-off sites and sites where objects may become trapped is thus reduced. By way of example, the coupler is embodied as a friction coupler or as a decoupler.

In accordance with a further embodiment, the household appliance comprises a control unit that is configured so as to control the motor in such a manner that the door performs a pivot movement.

It is thereby advantageously possible by way of example to realize a fully automated pivot movement of the door. By way of example, the control unit and the motor are coupled to one another for signal purposes. It is preferred that the control unit is configured so as to control a fully opening movement of the door. Furthermore, the control unit may be configured by way of example so as to control a fully closing movement of the door. By way of example, the control unit is connected to the coupler for signal purposes. In so doing, the control unit is configured so as to actuate the coupler, in particular the decoupler. By way of example, the control unit is configured so as to control the motor to open the door in order to counteract a build-up of noise within the household appliance.

In accordance with a further embodiment, the control unit is configured so as to switch the motor into a generator mode in order to generate a resistance against the pivot movement of the door.

It is advantageously possible thereby to optimize haptic feedback on the door. By way of example, it is possible with the aid of the resistance to compensate for the difference between the weight force of the door, which pulls on the cable, and the resilient force.

In accordance with a further embodiment, the household appliance comprises an operator interface that is configured so as to communicate with the control unit.

This has the advantage that different opening and closing functions of the door may be implemented in the household appliance. By way of example, the operator interface may be a push button, a touch display, a microphone or any other input apparatus or output apparatus. Furthermore, the operator interface comprises a sensor that is configured so as to detect an operator input, in particular an operator's gesture.

In accordance with a further embodiment, the household appliance comprises an output apparatus that is configured so as during the pivot movement of the door to output an acoustic signal and/or an optical signal.

This has the advantage that any people located in the proximity of the household appliance are warned with the aid of the acoustic signal and/or optical signal. It is possible hereby by way of example to avoid undesired collisions between the door and the people. It is preferred that the output apparatus comprises a loudspeaker for outputting the acoustic signal and/or a light source for outputting the optical signal.

In accordance with a further embodiment, the household appliance comprises a locking brake that is configured so as to prevent the cable drum performing a cable winding-on movement and/or a cable unwinding movement and/or to prevent the pivot movement of the door.

By way of example, the locking brake is configured so as to prevent the door falling down. It is preferred that the parking brake is connected to the control unit for signal purposes.

Furthermore, a household appliance is proposed having a housing, a door that is pivotably connected to the housing, a spring element, a cable, one end of which is connected to the door and the other end of which is connected to the spring element, and a linear drive that is fastened to the housing, is directly connected to the spring element and is configured so as to move the spring element in order to cause the door to perform a pivot movement.

It is possible with the aid of the linear drive that is directly connected to the spring element to provide a compact door-opening mechanism. Furthermore, it is possible to provide a simple and definite operating mechanism. It is preferred that the linear drive comprises a spindle drive or the linear drive is embodied as a spindle drive. The advantages and embodiments that are described for the household appliance having the cable drum apply accordingly for the household appliance that comprises the linear drive.

Further possible implementations of the method include also combinations that have not been explicitly mentioned of features or embodiments that have been previously described or are to be described below with regard to the exemplary embodiments. In so doing, the person skilled in the art will also add individual aspects as improvements or supplements to the respective basic format of the invention.

BRIEF DESCRIPTION OF THE DRAWINGS

Further advantageous embodiments and aspects of the invention are the subject matter of the dependent claims and also of the exemplary embodiments of the invention described below. In addition, the invention is further explained with the aid of the preferred embodiments with reference to the attached figures.

DETAILED DESCRIPTION OF EXEMPLARY EMBODIMENTS OF THE PRESENT INVENTION

Figure 1:
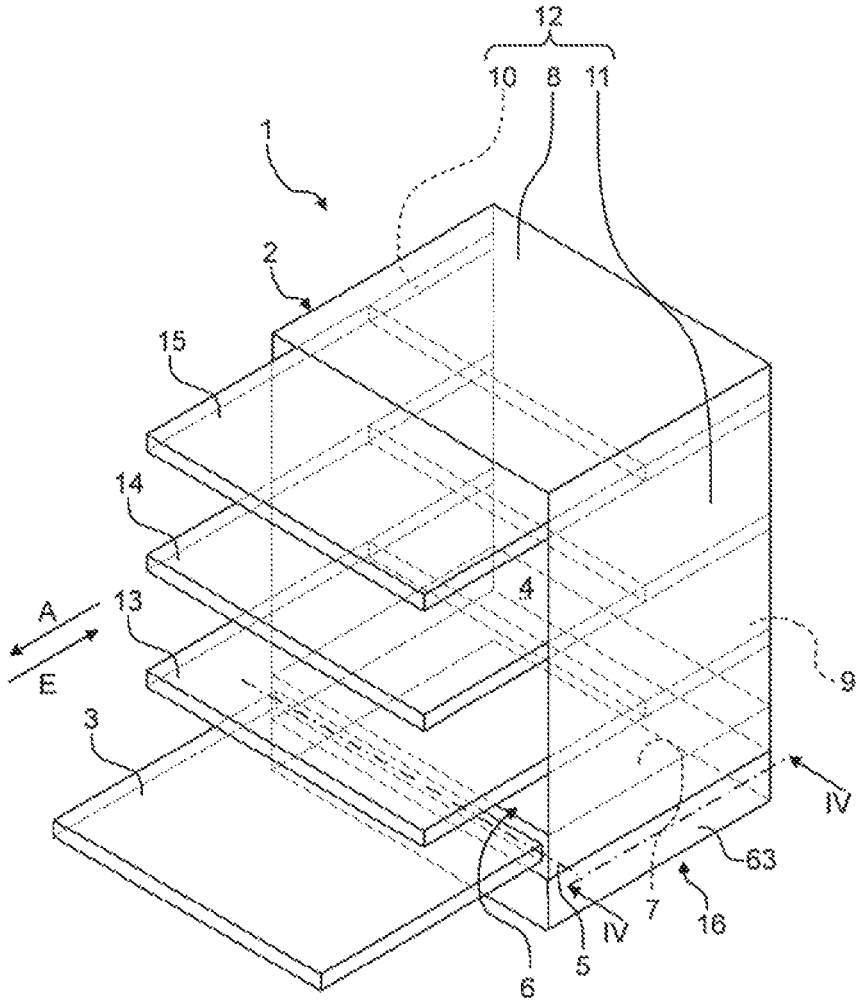
FIG. 1 shows a schematic perspective view of one embodiment of a household appliance.

In the figures, like or like-functioning elements are provided with the same reference numerals insofar as not otherwise stated.

FIG. 1 illustrates a schematic perspective view of a household appliance 1. The household appliance 1 is by way of example a household dishwasher. Alternatively, the household appliance 1 may be embodied as a washing machine, a refrigerating appliance, for example a refrigerator, or as an oven. The household appliance 1 comprises a dishwasher cavity 2 that may be closed in particular in a water-tight manner by a door 3. For this purpose, a sealing facility is provided between the door 3 and the dishwasher cavity 2. It is preferred that the dishwasher cavity 2 has a cuboid shape. The dishwasher cavity 2 is arranged in a housing 16 (only illustrated in part) of the household appliance 1. The dishwasher cavity 2 and the door 3 may form a dishwasher interior 4 for washing items that are to be washed.

The door 3 is illustrated in FIG. 1 in its open position. It is possible to close or open the door 3 by pivoting said door about a pivot axis 5 that is provided on a lower end of the door 3. It is possible with the aid of the door 3 to close or open a loading aperture 6 of the dishwasher cavity 2. The dishwasher cavity 2 comprises a base plate 7, a top plate 8 that is arranged opposite the base plate 7, a rear wall 9 that is arranged opposite the closed door 3 and two side walls 10, 11 that are arranged opposite one another. The base plate 7, the top plate 8, the rear wall 9 and the side walls 10, 11 may be manufactured by way of example from a steel sheet. In particular, it is possible by way of example to manufacture the base plate 7 from a different material than the top plate 8 and the side walls 10, 11. By way of example, the base plate 7 may be manufactured from the material 1.4301, the top plate 8 and the side walls 10, 11 may be manufactured from the material 1.4016 and the rear wall 9 likewise from the material 1.4916.

A first side wall 10, a second side wall 11 and the top plate 8 that is arranged between the first side wall 10 and the second side wall 11 are embodied as one piece, in particular from one piece of material, and form a dishwasher cavity jacket 12 of the dishwasher cavity 2. The dishwasher cavity jacket 12, the rear wall 9 and the base plate 7 are components that are manufactured separately from one another but they are connected to one another in a water-tight manner. The dishwasher cavity 2 is arranged on a base housing 63 and connected thereto. The household appliance 1 comprises a housing 16 that comprises the base housing 63 and the dishwasher cavity 2. The base housing 63 comprises a base 50, two outer walls 37, 41, (cf. FIG. 5) and a rear wall 36 that is arranged opposite the closed door 3 (cf. FIG. 5).

The household appliance 1 comprises moreover at least one receptacle 13 to 15 for items to be washed. It is preferred that multiple, by way of example three, receptacles 13 to 15 for items to be washed are provided, wherein the receptacle 13 for items to be washed may be a lower receptacle for receiving items to be washed or a lower basket, the receptacle 14 for items to be washed may be an upper receptacle for items to be washed or an upper basket and the receptacle 15 for items to be washed may be a cutlery drawer. As is further illustrated in FIG. 1, the receptacles 13 to 15 for items to be washed are arranged one above the other in the dishwasher cavity 2. Each receptacle 13 to 15 for items to be washed may be moved into and out of the dishwasher cavity 2 as desired. In particular, each receptacle 13 to 15 for items to be washed may be inserted in an insertion direction E into the dishwasher cavity 2 and drawn out of the dishwasher cavity 2 in a removal direction A opposite to the insertion direction E.

In lieu of the dishwasher cavity 2, it is also possible to provide a laundry cavity, a refrigerating cavity or a cooking cavity.

Figure 2:
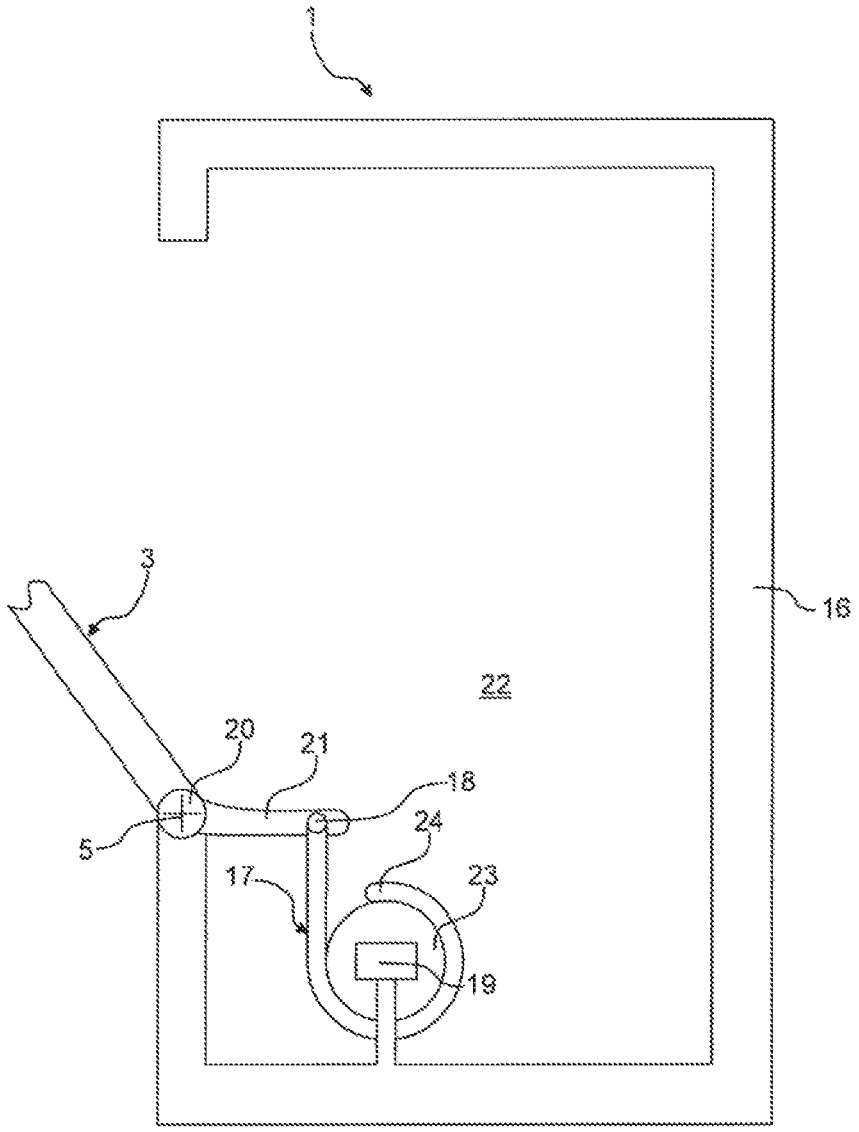
FIG. 2 shows a schematic side view of a further embodiment of a household appliance.

FIG. 2 illustrates a schematic side view of a further embodiment of the household appliance 1. The household appliance 1 comprises the housing 16 and the door 3 that is pivotably connected to the housing 16 with the aid of a hinge 20. Furthermore, the door 3 comprises a lever 21 that protrudes into an interior space 22 of the housing 16. It is possible by means of moving the lever 21 to open and close the entire door about the pivot axis 5 that extends through the hinge 20. Furthermore, the household appliance 1 comprises a cable 17, one end 18 of which is connected to the lever 21. In addition, the household appliance 1 comprises a motor 19 that is connected to the housing 16 or to the dishwasher cavity 3 (cf. FIG. 1), and said household appliance comprises a cable drum 23 onto which it is possible to at least in part wind the cable 17 and from which it is possible at least in part to unwind the cable 17. The cable 17 and the motor 19 are configured so as by means of winding the cable 17 onto the cable drum 23 or by means of unwinding the cable 17 from the cable drum 23 to cause the door 3 to perform a pivot movement. By way of example, the cable drum 23 is drivably connected to the motor 19. The motor 19 is configured so as to cause the cable drum 23 to perform a rotational movement. By way of example, a second end 24 of the cable 17 is fixedly connected to the cable drum 23.

Figure 3:
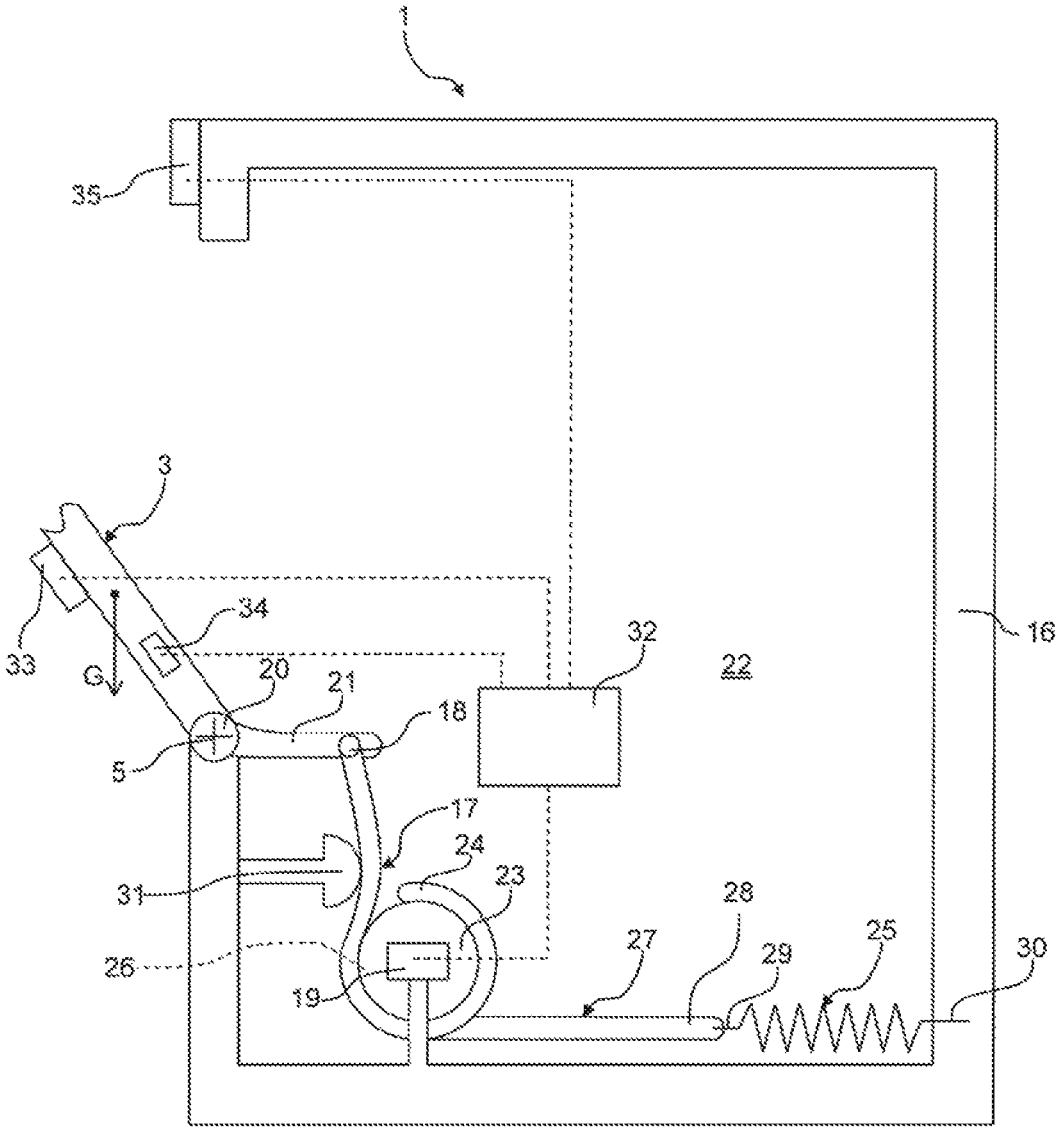
FIG. 3 shows a schematic side view of a further embodiment of a household appliance.

FIG. 3 illustrates a schematic side view of a further embodiment of the household appliance 1. In contrast to FIG. 2, the household appliance 1 comprises a spring element 25 that is configured so as to compensate at least in part for a weight force G of the door 3. Furthermore, the household appliance 1 comprises a rotational element 26 that is configured so as to tension the spring element 25 (rotational element 26 not visible in FIG. 3). By way of example, the rotational element 26 is rigidly connected to the cable drum 23. Consequently, the rotational element 26 simultaneously rotates as the cable drum 23 rotates.

Moreover, the household appliance 1 comprises an auxiliary cable 27 that is connected to the rotational element 26. In so doing, one end 28 of the auxiliary cable 27 is connected to one end 29 of the spring element 25. Furthermore, the other end 30 of the spring element 25 is connected to the housing 16. It is thus possible to tension the spring element 25 with the aid of the auxiliary cable 27. In so doing, the auxiliary cable 27 is released or pulled with the aid of the rotational element 26. As the auxiliary cable 27 is pulled, the spring element 25 is stretched and consequently pretensioned. As the auxiliary cable 27 is released, the spring element 25 is relaxed. The household appliance 1 comprises moreover a friction element 31 and the cable 17 rubs against said friction element. In so doing, a friction force is generated in order to prevent the door 3 from performing an undesired pivot movement. This is particularly helpful if owing to the weight force G of the door 3 a pulling force in the cable 17 exceeds a resilient force or if owing to the weight force G the resilient force exceeds the pulling force in the cable 17. For the event that the entire system is in a state of a balance of force, by way of example a single exertion of force on the lever 21 is sufficient to move the entire door 3 out of the resting position. In lieu of the friction elements 31, it is also possible to provide a deflecting roller.

The household appliance 1 comprises furthermore a control unit 32 that is configured so as to control the motor 19 in such a manner that the door 3 performs the pivot movement. The control unit 32 is coupled to the motor 19 for signal purposes (indicated by the broken line). The control unit 32 is configured so as to switch the motor 19 into a generator mode in order to generate a resistance against the pivot movement of the door 3. It is thereby possible by way of example to improve a haptic feedback for an operator who is manually performing the pivot movement of the door 3. By way of example, the household appliance 1 comprises an operator interface 33 that is configured so as to communicate with the control unit 32. The operator interface 33 may comprise a push button, a touch display, a microphone, a sensor or any other input apparatus or output apparatus. The operator interface 33 is coupled to the control unit 32 for signal purposes (indicated by the broken line). Furthermore, the household appliance 1 may comprise a sensor 34 that is arranged by way of example in the door 3 or in the hinge 20 and is configured so as to detect the pivot movement of the door 3. The sensor 34 is also connected to the control unit 32 for signal purposes (indicated by the broken line). By way of example, it is possible with the aid of the operator interface 33 and/or the sensor 34 for the door 3 to be closed automatically with the aid of contact with the operator's foot or with the aid of a position or gesture of the operator's foot being detected. Furthermore, it is conceivable to initiate a fully closing movement or fully opening movement of the door 3 with the aid of an App control procedure. By way of example, the closed door 3 opens with the aid of pressure being applied by the operator of the household appliance 1. By way of example, the door 3 is pushed downward or upward in any desired position and the door movement is then automatically continued. In addition, it is possible by way of example to provide that the door 3 is opened with the aid of an actuation of the operator interface 33, in particular a button actuation.

Moreover, the household appliance 1 comprises an output apparatus 35 that is configured so as during the pivot movement of the door 3 to output an acoustic signal. The output apparatus 35 comprises by way of example a loud speaker. By way of example, the output apparatus 35 is coupled to the control unit 32 for signal purposes (indicated by the broken line).

The cable 17 and/or the lever 21 and/or the cable drum 23 and/or the motor 19 and/or the rotational element 26 and/or the auxiliary cable 27 and/or the spring element 25 may by way of example be configured as described above or below and may be provided in a redundant manner in particular along the side wall 10 (cf. FIG. 1) and along the side wall 11 (cf. FIG. 1).

Figure 4:
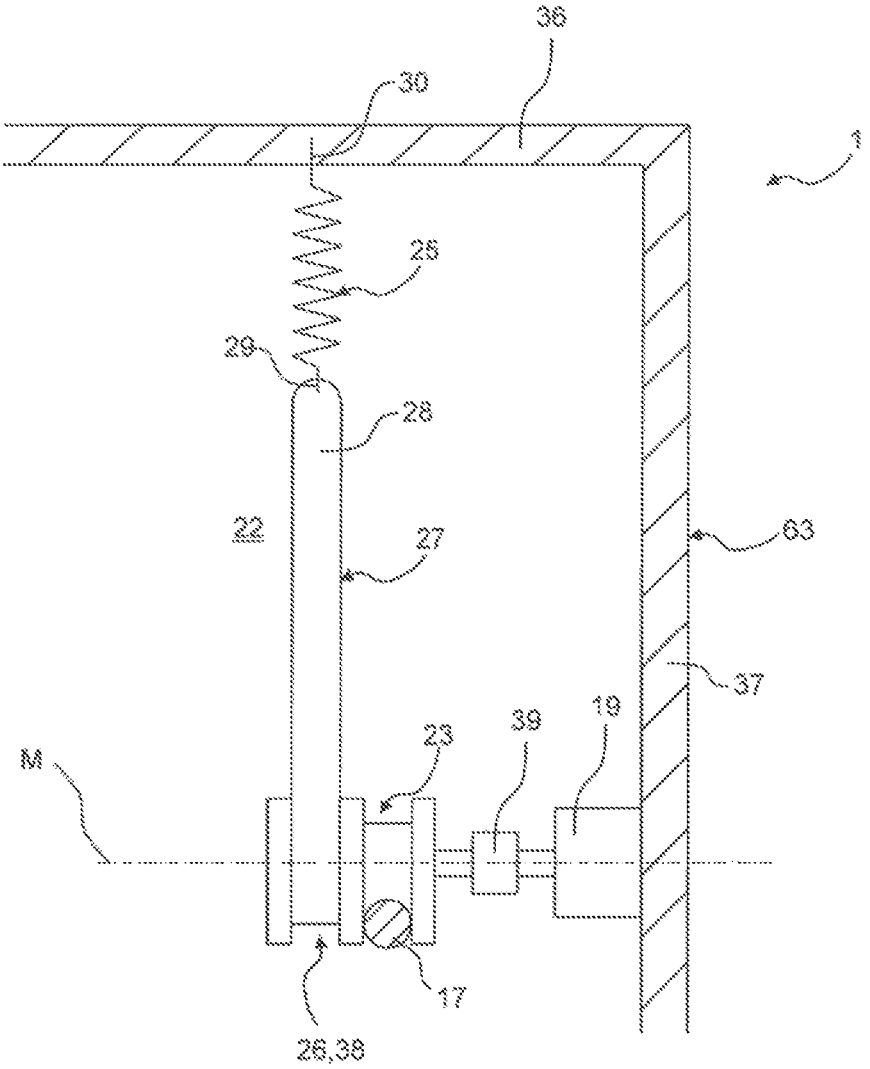
FIG. 4 shows a schematic partial section IV-IV from FIG. 1.

FIG. 4 illustrates a partial section IV-IV from FIG. 1 that extends in a horizontal manner through the household appliance 1. The base housing 63 comprises in this case the outer wall 37. Furthermore, the rotational element 26 is embodied as an auxiliary cable drum 38. The auxiliary cable drum 38 is fixedly connected to the cable drum 23. In so doing, it is possible by way of example to design the auxiliary cable drum 38 and the cable drum 23 in an identical manner to one another. By way of example, the cable drum 23 and the auxiliary cable drum 38 may be embodied as a double cable drum. In particular, the cable drum 23 and the auxiliary cable drum 38 are manufactured from metal or synthetic material. By way of example, the cable drum 23 and the auxiliary cable drum 38 are arranged in a coaxial manner and may rotate about a central axis M. In particular, the cable drum 23 and the auxiliary cable drum 38 may be arranged in rotational symmetry with regard to the central axis M. By way of example, the auxiliary cable 27 may be wound at least in part onto the auxiliary cable drum 38 and unwound at least in part from the auxiliary cable drum 38 and one end 28 of said auxiliary cable may be connected to the spring element 25.

The motor 19 is by way of example connected to the outer wall 37 and arranged in a coaxial manner with respect to the cable drum 23 and to the auxiliary cable drum 38. By way of example, the cable drum 23 and the auxiliary cable drum 38 are mounted on the motor 19, wherein a coupler 39 is arranged between the cable drum 23 and the motor 19. By way of example, the coupler 39 is configured so as to disconnect a drive connection between the motor 19 and the cable drum 23 and/or the cable 17. The coupler 39 is by way of example a friction coupler. By way of example, the cable drum 23 is flange-mounted onto the motor 19.

Figure 5:
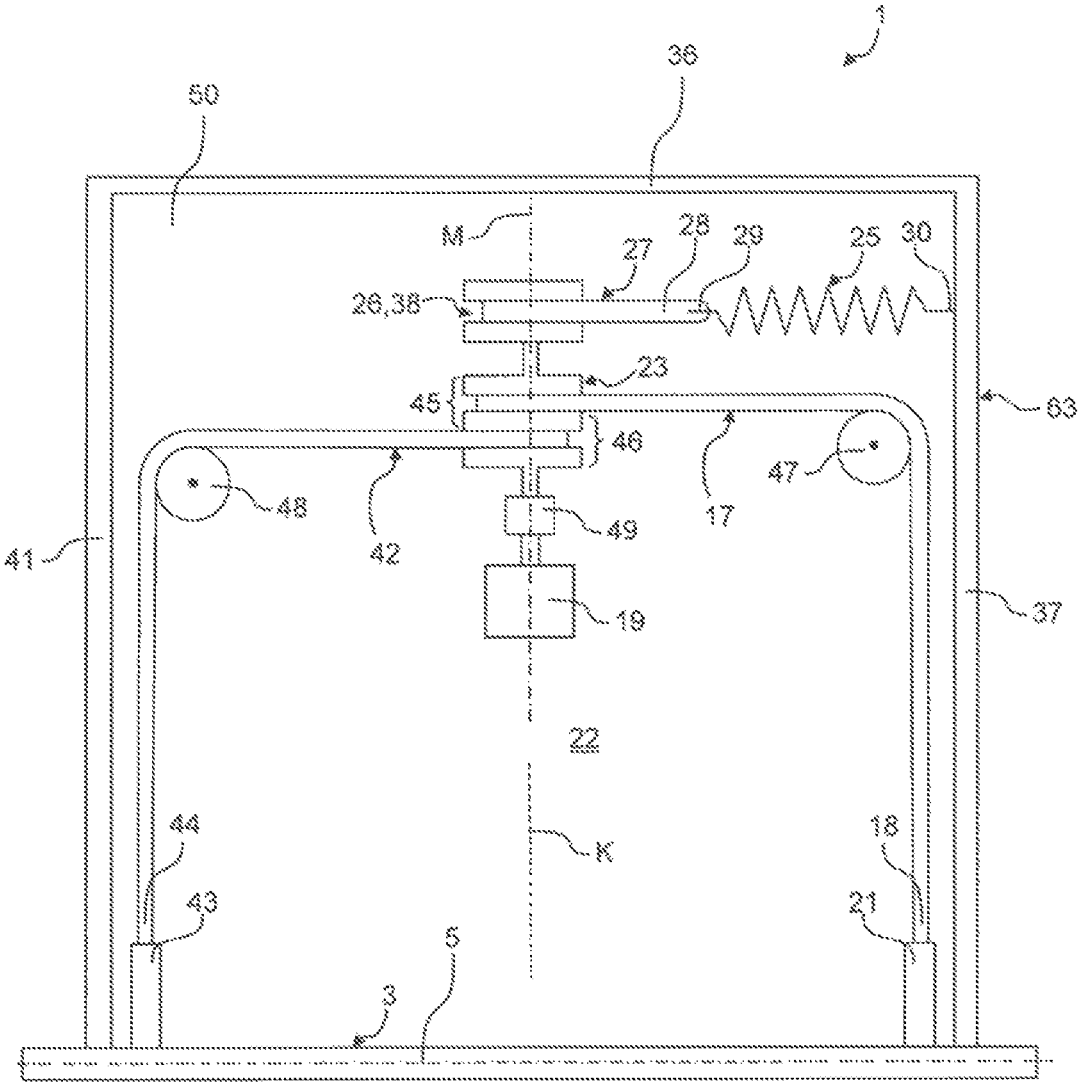
FIG. 5 shows a schematic view of a further embodiment of a household appliance.

FIG. 5 illustrates in a schematic view a further embodiment of the household appliance 1. In this case, the household appliance 1 comprises a further cable 42, one end 44 of which is connected to a further lever 43 of the door 3, wherein the cable 17 and the further cable 42 may be wound synchronously at least in part onto the cable drum 23 and may be unwound at least in part from the cable drum 23. The cable 17, the further cable 42 and the motor 19 are configured so as by means of winding the cable 17 and the further cable 42 onto the cable drum 23 or unwinding the cable 17 and the further cable 42 from the cable drum 23 to cause the door 3 to perform the pivot movement. The cable drum 23 comprises in this case a first section 45 from which the cable 17 may be unwound. Furthermore, the cable drum 23 comprises a second section 46 from which the further cable 42 may be unwound. The first section 45 and the second section 46 are arranged adjacent to one another and in a coaxial manner with respect to the central axis M. By way of example, the second section 46 is formed as one on the first section 45 from one piece of material. The first section 45 and the second section 46 may be designed by way of example in an identical manner to one another.

The cable 17 extends from the first section 45 to the outer wall 37, extends around a deflecting roller 47 and continues to extend along the outer wall 37 to the door 3. It is preferred that the cable 17 is deflected by 90° by means of the deflecting roller 47. The further cable 42 extends from the second section 46 to the outer wall 41, extends around a deflecting roller 48 and continues to extend along the outer wall 41 to the door 3. It is preferred that the deflection by 90° is realized with the aid of the deflecting roller 48. It is advantageous that the two cables 17, 42 are unwound and wound-on with the aid of a single motor 19, said cables each being fastened to the door 3. In addition, the auxiliary cable drum 38 is also driven with the aid of the motor and it is possible for the aid of said auxiliary cable drum to stress and relax the spring element 25 in order to compensate for the weight force G of the door 3.

Moreover, the household appliance 1 comprises a locking brake 48 that is configured so as to prevent a winding-on movement and/or an unwinding movement of the cable drum 23 and/or to prevent a pivot movement of the door 3. By way of example, the locking brake 49 is arranged between the motor 19 and the cable drum 23. Alternatively, the locking brake 49 may also be provided in the motor 19. By way of example, it is possible with the aid of the locking brake 39 to fix a specific opening angle of the door 3.

The motor 19, the cable drum 23 and the auxiliary cable drum 38 may be provided centrally in the household appliance 1. Consequently, the central axis M extends through a vertical plane K that divides the household appliance 1 into two halves of equal size. Furthermore, the auxiliary cable 27 extends from the auxiliary cable drum 38 to the outer wall 37, wherein the auxiliary cable 27 is connected to the outer wall 37 with the aid of the spring element 25. Alternatively, the auxiliary cable may extend to the outer wall 41 and may be connected to the outer wall 41 with the aid of the spring element 25. In addition, the central axis M extends from the closed door 3 to the rear wall 36. The motor 19 and/or the cable drum 23 and/or the auxiliary cable drum 38 and/or the cable 17 and/or the further cable 42 and/or the auxiliary cable 27 and/or the spring element 25 may be arranged by way of example between the base 50 of the base housing 63 and the base plate 7 (cf. FIG. 1) of the dishwasher jacket 12.

Figure 6:
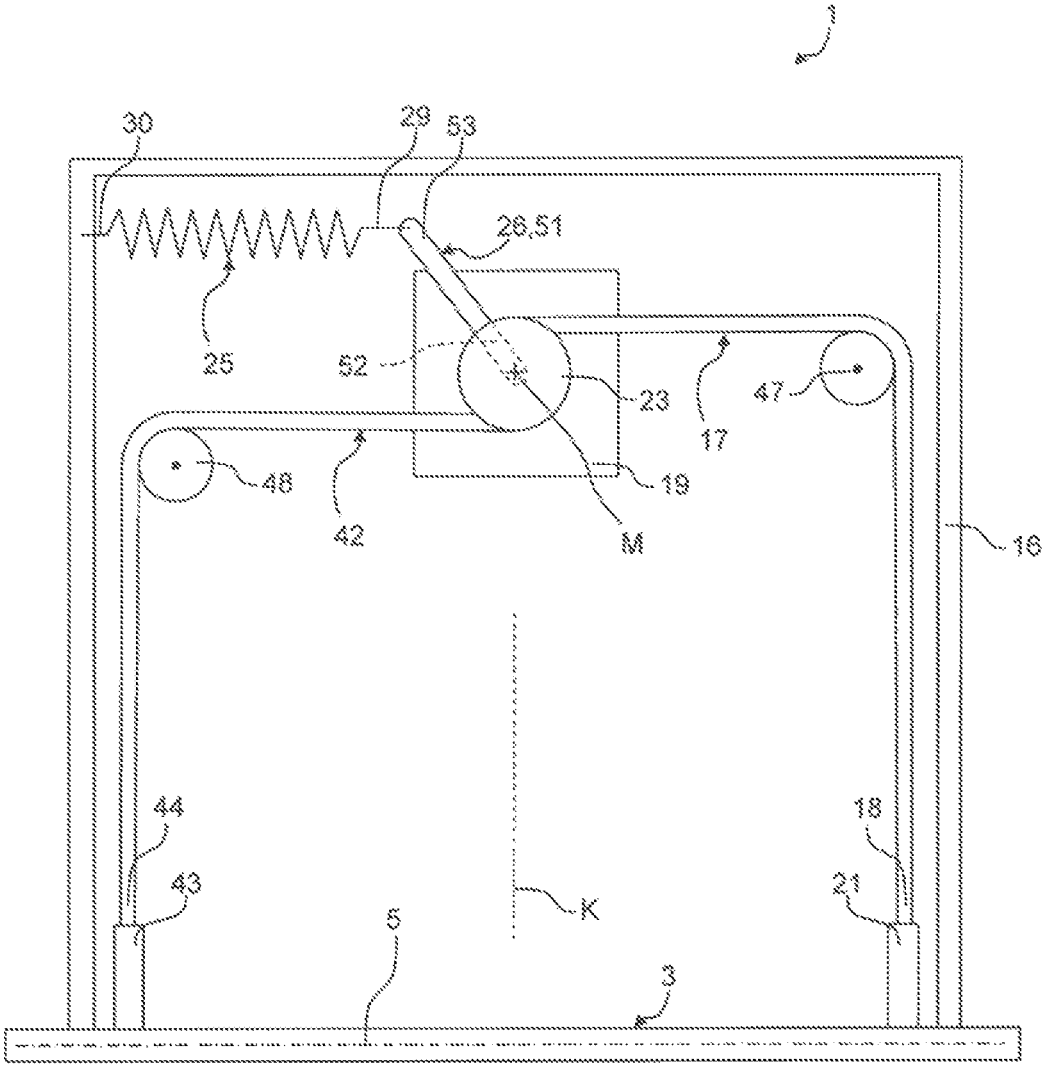
FIG. 6 shows a schematic view of a further embodiment of a household appliance.

FIG. 6 illustrates in a schematic view a further embodiment of the household appliance 1. In contrast to FIG. 5, the central axis M extends in a vertical manner upward from the base 50 to the top plate 8 (cf. FIG. 1). Consequently, at least the motor 19 and the cable drum 23 are oriented in a different manner to that illustrated in FIG. 5. In addition, the rotational element 26 is embodied as a lever 51. The lever 51 is coupled in a rigid manner to the cable drum 23 and rotates about the central axis M if the cable 17 is wound onto and/or unwound from said cable drum. In so doing, one end 52 of the lever 51 is connected to the cable drum 23 and the other end 53 of said lever is fastened to one end 29 of the spring element 25. Consequently, the lever 51 is drivably connected to the cable drum 23 and connected to the spring element 25. A pivot movement of the lever 51 is produced with the aid of the motor 19 and thereby the spring element 25 is tensioned and/or relaxed.

Figure 7:
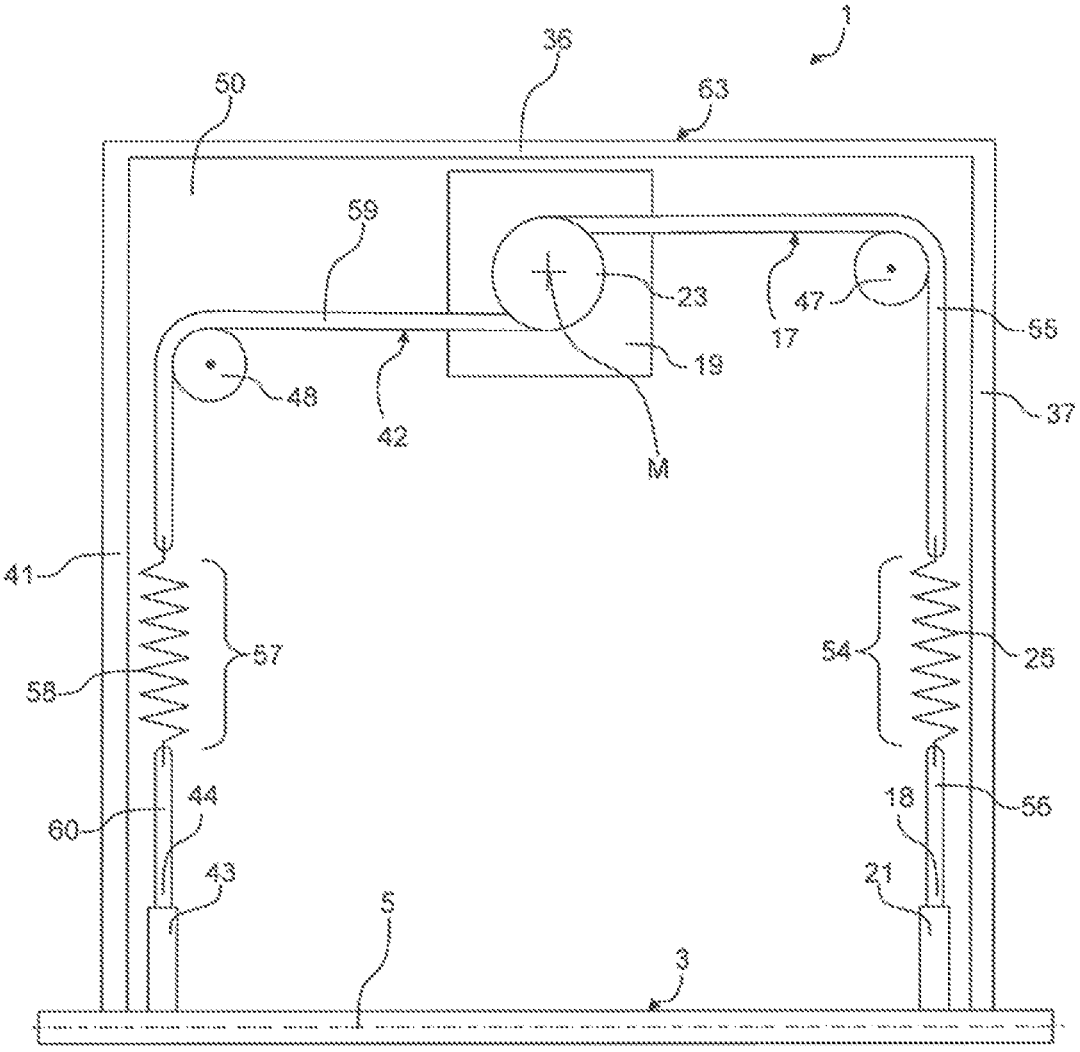
FIG. 7 shows a schematic view of a further embodiment of a household appliance.

FIG. 7 illustrates in a schematic view a further embodiment of the household appliance 1. In contrast to FIG. 6, a rotational element 26 is not provided. Furthermore, the cable 17 has an uninterrupted region 54 in which the spring element 25 is arranged. In other words, the cable 17 is divided into a first cable section 55 and a second cable section 56 that are connected with the aid of the spring element 25. The spring element 25 is connected to the door 3 with the aid of the second cable section 56. In a similar manner thereto, the further cable 42 has an uninterrupted region 57 in which a further spring element 58 is arranged. In other words, the further cable 42 is divided into a first cable section 59 and a second cable section 60 that are connected to one another with the aid of the further spring element 58. The further spring element 58 is connected to the door 3 with the aid of the second cable section 60.

Figure 8:
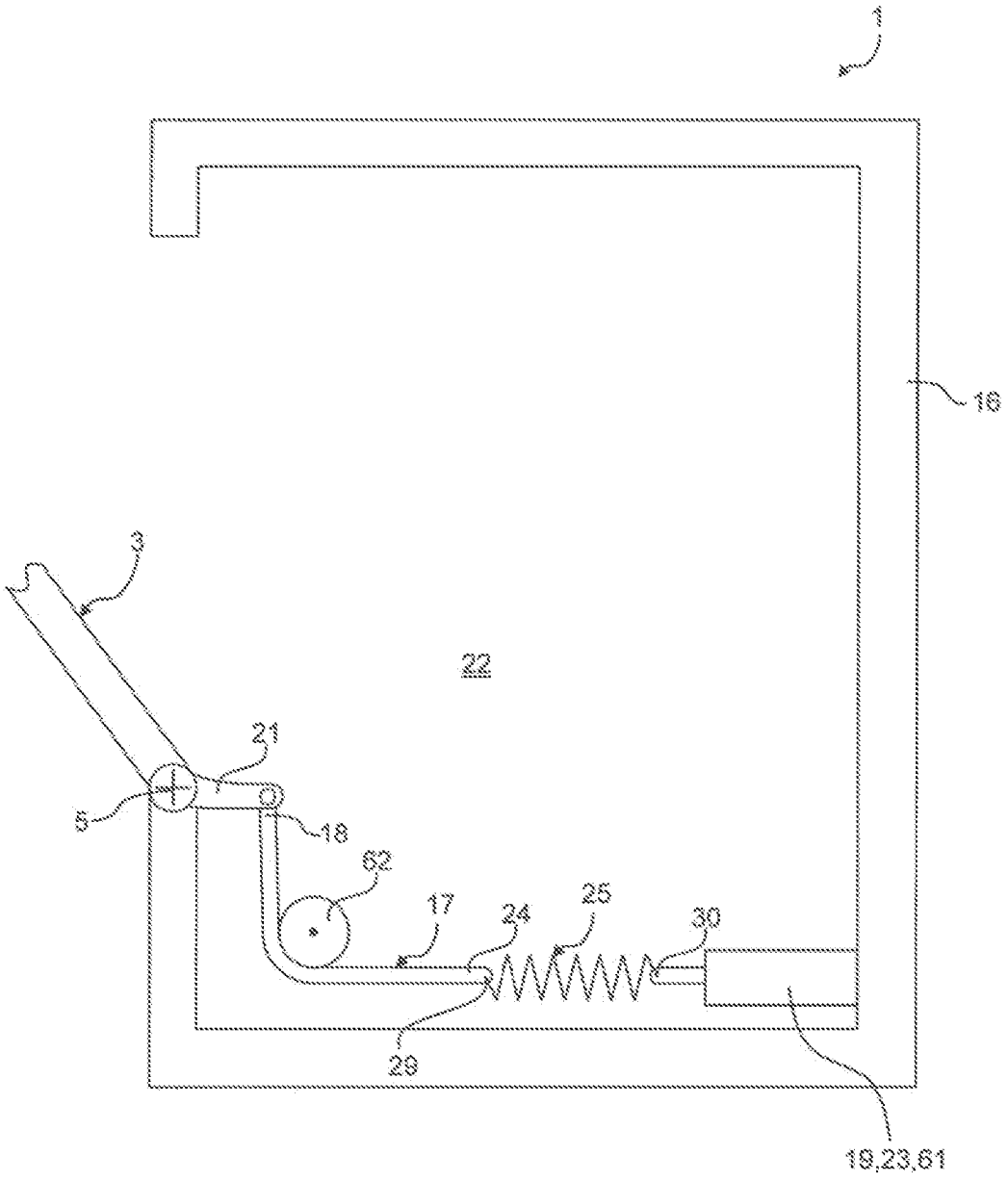
FIG. 8 shows a schematic side view of a further embodiment of a household appliance.

FIG. 8 illustrates a schematic side view of a further embodiment of the household appliance 1. The household appliance 1 comprises the housing 16, the door 3 that is pivotably connected to the housing 16, the spring element 25, the cable 17, one end 18 of which is connected to the door 3 and the other end 24 of which is connected to the spring element 25, and a linear drive 61, that is fastened to the housing 16, is directly connected to the spring element 25 and is configured so as to move the spring element 25 in order to cause the door 3 to perform a pivot movement.

In doing so, one end 18 of the cable 17 is connected to the lever 21 and the other end 24 of the cable 17 is connected to the end 29 of the spring element 25. The other end 30 of the spring element 25 is in turn connected to the linear drive 61. Furthermore, the cable 17 is deflected with the aid of an element 62 that may be embodied as a deflecting roller or friction element. It is possible with the aid of the linear drive 61 to displace the spring element 25 in a translational manner. The cable 17 is moved accordingly with the aid of this translational displacement with the result that the door 3 completes the pivot movement. By way of example, it is possible in lieu of the linear drive 61 to provide the motor 19, as described in FIG. 2 to FIG. 7. Furthermore, the motor 19 having the cable drum 23 may be provided in lieu of the linear drive 61. A motor 19 that is connected in this manner downstream with regard to the spring element is by way of example configured so as to change the extent to which the spring element 25 is pretensioned.

The cable 17 and/or the further cable 42 and/or the auxiliary cable 27 may comprise multiple cable sections that are separated from one another and are mechanically connected to one another. Furthermore, it is possible to provide any number of friction elements or deflecting rollers in order to deflect the cables 17, 27, 42 or to generate friction in a purposeful manner. Furthermore, the cables 17, 27, 42 may comprise any desired material. The cables 17, 27, 42 may comprise by way of example metal, synthetic material or any other material.

Although the present invention has been described with the aid of exemplary embodiments, it may be modified in numerous ways.

The invention claimed is:

1. A household appliance, comprising:

a housing;

a door pivotably connected to the housing by a hinge, the door comprising a lever;

a cable having one end connected to the lever;

a motor; and a cable drum capable of allowing the cable to be wound at least in part thereon and allowing the cable to be unwound at least in part, wherein the cable and the motor interact such that the door pivots when winding the cable onto the cable drum or pivots when the cable unwinds from the cable drum.

2. The household appliance of claim 1, constructed in the form of a water-utilizing household appliance.

3. The household appliance of claim 1, wherein the cable drum is drivably connected to the motor and/or is flange-mounted onto the motor.

4. The household appliance of claim 1, further comprising a further cable having one end connected to the door, the cable and the further cable capable of being wound at least in part onto the cable drum in synchronism and capable of being unwound at least in part from the cable drum in synchronism, wherein the cable, the further cable and the motor interact such that the door pivots when winding the cable and the further cable onto the cable drum or pivots when the cable and the further cable unwind from the cable drum.

5. The household appliance of claim 1, further comprising a spring element configured to compensate at least in part for a weight force of the door.

6. The household appliance of claim 5, further comprising a rotational element configured to tension the spring element.

7. The household appliance of claim 6, further comprising an auxiliary cable having an end connected to the spring element, said rotational element embodied as an auxiliary cable drum onto which the auxiliary cable is capable of being wound at least in part and from which the auxiliary cable is capable of being unwound at least in part.

8. The household appliance of claim 6, wherein the rotational element is embodied as the lever that is drivably connected to the cable drum and is connected to the spring element.

9. The household appliance of claim 5, wherein the spring element has a first end which is connected to another end of the cable, and a second end which is connected to at least one of the motor and the cable drum.

10. The household appliance of claim 1, further comprising a coupler configured to disconnect a drive connection between the motor and at least one of the cable drum and the cable.

11. The household appliance of claim 1, further comprising a control unit configured to control the motor in such a manner as to cause the door to perform a pivot movement.

12. The household appliance of claim 11, wherein the control unit is configured to switch the motor into a generator mode in order to generate a resistance against the pivot movement of the door.

13. The household appliance of claim 11, further comprising an operator interface configured to communicate with the control unit.

14. The household appliance of claim 1, further comprising an output apparatus configured to output an acoustic signal and/or an optical signal during a pivot movement of the door.

15. The household appliance of claim 1, further comprising a locking brake configured to prevent at least one action selected from the group consisting of winding-on movement of the cable, unwinding movement of the cable drum, and pivot movement of the door.

* * * * *